US006399553B1

(12) United States Patent
Cable et al.

(10) Patent No.: US 6,399,553 B1
(45) **Date of Patent: *Jun. 4, 2002**

(54) REDUCED RESIDUE HARD SURFACE CLEANER

(75) Inventors: Elizabeth A. Cable, Livermore; Aram Garabedian, Jr., Fremont, both of CA (US)

(73) Assignee: The Clorox Company, Oakland, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/869,854

(22) Filed: Jun. 5, 1997

(51) Int. Cl.[7] ..... C11D 1/37; C11D 3/43; C11D 3/20; C11D 3/26

(52) U.S. Cl. ..... 510/182; 510/180; 510/181; 510/365; 510/426; 510/427; 510/428; 510/432; 510/435; 510/506

(58) Field of Search ..... 510/182, 432, 510/506, 427, 365, 180, 181, 426, 428, 435

(56) References Cited

U.S. PATENT DOCUMENTS

| | | | | | |
|---|---|---|---|---|---|
| 4,213,873 | A | | 7/1980 | Church | 252/174.21 |
| 4,315,828 | A | | 2/1982 | Church | 252/153 |
| 4,960,779 | A | | 10/1987 | Baker et al. | 252/546 |
| 5,252,245 | A | * | 10/1993 | Garabedian, Jr. et al. | 252/153 |
| 5,362,422 | A | | 11/1994 | Masters | 252/544 |
| 5,437,807 | A | | 8/1995 | Garabedian, Jr. et al. | 252/153 |
| 5,468,423 | A | | 11/1995 | Garabedian, Jr. et al. | 252/546 |
| 5,494,611 | A | * | 2/1996 | Howe | 252/548 |
| 5,523,024 | A | | 6/1996 | Garabedian, Jr. et al. | 252/547 |
| 5,585,342 | A | | 12/1996 | Choy et al. | 510/433 |
| 5,604,195 | A | * | 2/1997 | Misselyn et al. | 510/400 |
| 5,714,448 | A | | 2/1998 | Choy et al. | 510/181 |

FOREIGN PATENT DOCUMENTS

| | | |
|---|---|---|
| WO | WO97/30140 | 8/1997 |

* cited by examiner

*Primary Examiner*—Yogendra Gupta
*Assistant Examiner*—Gregory E. Webb
(74) *Attorney, Agent, or Firm*—Joel J. Hayashida

(57) ABSTRACT

The invention provides an aqueous, hard surface cleaner with significantly improved residue removal and substantially reduced filming/streaking, said cleaner comprising:

(a) an effective amount of at least one organic solvent with a vapor pressure of at least 0.001 mm Hg at 25° C., and mixtures of such solvents;

(b) an effective amount of a mixture of anionic surfactants;

(c) an effective amount of a buffering system which comprises a nitrogenous buffer which will result in a pH of greater than 6.5; and (d) the remainder as substantially all water.

16 Claims, No Drawings

REDUCED RESIDUE HARD SURFACE CLEANER

BACKGROUND OF THE INVENTION

1. Field of the Invention

The invention relates to a non-rinse, isotropic hard surface cleaner especially adapted to be used on glossy or smooth, hard surfaces, such as glass windows and the like, which removes soils deposited thereon, while significantly reducing the amount of residue caused by unremoved soil, cleaner, or a combination thereof. The inventive cleaner advantageously delivers an auditory "clean" signal, the sound of a wicking implement, such as a cleaning cloth or sponge, squeaking or squealing when the cleaner is removed therewith from a smooth, glossy surface, such as a glass or mirrored surface.

2. Brief Statement of the Related Art

Cleaning hard, glossy surfaces such as glass windows has proven to be problematic. To remove soils deposited on such surfaces, the typical approach is to use an alkaline ammonium-based aqueous cleaner or other aqueous cleaners containing various mixtures of surfactants and other cleaning additives. Unfortunately, many of the ammonia-based cleaners have fairly poor soil removing ability, while many of the surfactant-based cleaners leave fairly significant amounts of residue on such hard, glossy surfaces. This residue is seen in the phenomena of streaking, in which the soil, cleaner, or both are inconsistently wicked off the surface, and filming, in which a thin layer of the residue actually clings to the surface desired to be cleaned.

Baker et al., U.S. Pat. No. 4,690,779, demonstrated a hard surface cleaner having improved non-streaking/filming properties in which a combination of low molecular weight polymer (e.g., polyethylene glycol) and certain surfactants were combined.

Church, U.S. Pat. Nos. 4,213,873 and 4,315,828, disclose hard surface cleaners containing water, a cleaning agent (ammonium hydroxide or an alcohol), and a lubricity agent, which is typically a polymer, but allegedly can include a mixture of ammonium carbonate and ammonium carbamate.

Corn et al., E.P. 0393772 and E.P. 0428816, describe hard surface cleaners containing anionic surfactants with ammonium counterions, and additional adjuncts.

G.B. 2,160,887 describes a cleaning system in which a combination of nonionic and anionic surfactants (including an alkanolamine salt alkyl sulfate) is contended to enhance cleaning efficacy.

WO 91/11505 describes a glass cleaner containing a zwitterionic surfactant, monoethanolamine and/or beta-aminoalkanols as solvents/buffers for assertedly improving cleaning and reducing filming spotting.

Garabedian et al., U.S. Pat. Nos. 5,252,245, 5,437,807, 5,468,423 and 5,523,024, and Choy et al., U.S. Pat. No. 5,585,342, all of common assignment herewith, disclose improved glass and surface cleaners which combine either amphoteric or nonionic surfactants with solvents and effective buffers to provide excellent streaking/filming characteristics on glass and other smooth, glossy surfaces. These disclosures are incorporated herein by reference thereto.

SUMMARY OF THE INVENTION AND OBJECTS

The invention provides an aqueous, hard surface cleaner with significantly improved residue removal and substantially reduced filming/streaking, said cleaner comprising:

(a) an effective amount of at least one organic solvent with a vapor pressure of at least 0.001 mm Hg at 25° C., and mixtures of such solvents;

(b) an effective amount of a mixture of anionic surfactants;

(c) an effective amount of a buffering system which comprises a nitrogenous buffer which will result in a pH of greater than 6.5; and (d) the remainder as substantially all water.

The invention provides an all-temperature, improved glass and other hard surface cleaner having excellent streaking/filming performance as compared to the prior art. The improvement is especially striking when cleaning glass and other glossy, hard surfaces with the invention.

In another embodiment of the invention, the cleaner further comprises (e) an effective amount of an additional dispersant, namely, an n-alkylpyrrolidone. This particular adjunct has proven to be surprisingly effective at both dispersing highly insoluble organic materials, particularly, fragrance oils, while simultaneously enhancing or maintaining the effective minimization of streaking/filming of the surfaces cleaned with the inventive cleaner.

The invention further comprises a method of cleaning soils from hard surfaces by applying said inventive cleaner to said soil (such as by, e.g., using a pump or trigger sprayer to conveniently and effectively deliver metered amounts of the cleaner to the soiled surface), and removing both from said surface.

It is therefore an object of this invention to substantially eliminate filming which results from a residue of cleaner, soil, or both remaining on the hard surface intended to be cleaned.

It is another object of this invention to substantially eliminate streaking, which results from inconsistent removal of the cleaner, soil, or both, from the hard surface intended to be cleaned.

It is also an object of this invention to provide a cleaner for glass and other hard, glossy surfaces, which has virtually no filming or streaking.

DETAILED DESCRIPTION OF THE INVENTION

The invention is an improved cleaning, substantially non-streaking/filming hard surface cleaner especially adapted to be used on glossy or smooth, hard surfaces, emblematic of which is glass. The cleaner benefits from the use of a novel surfactant which contributes unexpectedly to the complete removal of soils and the cleaner from the surface being cleaned. The cleaner itself has the following ingredients:

(a) an effective amount of at least one organic solvent with a vapor pressure of at least 0.001 mm Hg at 25° C., and mixtures of such solvents;

(b) an effective amount of a mixture of anionic surfactants;

(c) an effective amount of a buffering system which comprises a nitrogenous buffer which will result in a pH of greater than 6.5; and (d) the remainder as substantially all water.

Additional adjuncts in small amounts such as fragrance, dye and the like can be included to provide desirable attributes of such adjuncts. In a further embodiment of the invention, especially when a fragrance is used, a further adjunct (e) a 1-alkyl-2-pyrrolidone is added in amounts effective, along with the anionic surfactant, to disperse the fragrance and to improve or maintain the reduced streaking/filming performance of the inventive cleaner.

In the application, effective amounts are generally those amounts listed as the ranges or levels of ingredients in the descriptions which follow hereto. Unless otherwise stated, amounts listed in percentage ("%'s") are in weight percent of the composition, unless otherwise noted.

1. Solvents

The solvents useful in this invention are organic solvents with a vapor pressure of at least 0.001 mm Hg at 25° C. and soluble to the extent of at least 1 g/100 ml water. The upper limit of vapor pressure appears to be about 100 mm Hg at 25° C. Vapor pressure is a useful measure for determining the applicability of the given solvent, since one would select a solvent which will volatilize sufficiently so as to leave no visible residue. The organic solvent of the invention is preferably selected from $C_{1-6}$ alkanol, $C_{3-24}$ alkylene glycol ether, and mixtures thereof. However, other, less water soluble or dispersible organic solvents may also be utilized. It is preferred that a mixture of the $C_{1-6}$ alkanol and $C_{3-24}$ alkylene glycol ether solvents be used. The alkanol can be selected from methanol, ethanol, n-propanol, isopropanol, butanol, pentanol, hexanol, their various positional isomers, and mixtures of the foregoing. In the invention, it has been found most preferable to use isopropanol, usually in conjunction with a glycol ether. It may also be possible to utilize in addition to, or in place of, said alkanols, the diols such as methylene, ethylene, propylene and butylene glycols, and mixtures thereof. Other solvents, such as ketones, ethers, hydrocarbons and halides may be used. Other examples of solvents can be found in *Kirk-Othmer, Encyclopedia of Chemical Technology* 3rd, Vol. 21, pp. 377–401 (1983), incorporated by reference herein.

The alkylene glycol ether solvents can include ethylene glycol monobutyl ether, ethylene glycol monopropyl ether, propylene glycol monopropyl ether, propylene glycol monobutyl ether, and mixtures thereof. One particularly preferred glycol ether is ethylene glycol, monobutyl ether, also known as 2-butoxyethanol, sold as Dowanol EB from Dow Chemical, while another commercially available one is Butyl Cellosolve by Union Carbide. The use of these particular glycol ethers in the invention results in a very low to minimal foaming cleaner, both upon application (spraying) and removal from (wiping) a hard surface. Another preferred alkylene glycol ether is propylene glycol, t-butyl ether, which is commercially sold as Arcosolve PTB, by Arco Chemical Co. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. However, in some of the compositions of this invention, no solvent may be present. A preferred range is about 1–15%, and if a mixed solvent system of alkanol/glycol ether is used, the ratio of alkanol to alkylene glycol ether should be about 1:20 to 20:1, more preferably about 1:10 to 10:1 and most preferably about 1:5 to 5:1.

As mentioned above, other, less water soluble or dispersible organic solvents may also be utilizable herein, although in a high water formulation, there may be a need for a further dispersant (e.g., hydrotrope or other emulsifier). These less water soluble or dispersible organic solvents include those commonly used as constituents for proprietary fragrance blends, such as terpene derivatives. The terpene derivatives herein include terpene hydrocarbons with a functional group. Effective terpenes with a functional group include, but are not limited to, alcohols, ethers, esters, aldehydes and ketones.

Representative examples for each of the above classes of terpenes with functional groups include but are not limited to the following: Terpene alcohols, including, for example, verbenol, transpinocarveol, cis-2-pinanol, nopol, isoborneol, carbeol, piperitol, thymol, α-terpineol, terpinen-4-ol, menthol, 1,8-terpin, dihydro-terpineol, nerol, geraniol, linalool, citronellol, hydroxycitronellol, 3,7-dimethyl octanol, dihydro-myrcenol, tetrahydro-alloocimenol and perillalcohol; Terpene ethers and esters, including, for example, 1,8-cineole, 1,4-cineole, isobornyl methylether, rose pyran, α-terpinyl methyl ether, menthofuran, trans-anethole, methyl chavicol, allocimene diepoxide, limonene mono-epoxide, iso-bornyl acetate, nopyl acetate, α-terpinyl acetate, linalyl acetate, geranyl acetate, citronellyl acetate, dihydro-terpinyl acetate and neryl acetate; Terpene aldehydes and ketones, including, for example, myrtenal, campholenic aldehyde, perillaldehyde, citronellal, citral, hydroxy citronellal, camphor, verbenone, carvenone, dihyro-carvone, carvone, piperitone, menthone, geranyl acetone, pseudo-ionone, α-ionone, β-ionone, iso-pseudo-methyl ionone, normal-pseudo-methyl ionone, iso-methyl ionone and normal-methyl ionone.

Terpene hydrocarbons with functional groups which appear suitable for use in the present invention are discussed in substantially greater detail by Simonsen and Ross, *The Terpenes,* Volumes I–V, Cambridge University Press, 2nd Ed., 1947 (incorporated herein by reference thereto). See also, the commonly assigned U.S. Pat. No. 5,279,758, of Choy, incorporated herein by reference thereto.

2. Surfactants

The principal surfactants used in the inventive hard surface cleaner are anionic surfactants, for both cleaning and desirable foaming characteristics. The anionic surfactant is selected from alkyl sulfates, primary and secondary alkane sulfonates, alkyl diphenyl oxide disulfonates, alkylbenzene sulfonates, alkylsulfonates, isothionates, alkylethersulfates, α-olefin sulfonates, alkyl taurates, alkyl sarcosinates and the like. Each of these surfactants is generally available as the alkali metal, alkaline earth and ammonium salts thereof. These surfactants can include both straight and branched alkyl chains, or mixtures thereof. The preferred anionic surfactants are alkyl sulfates—more preferably, $C_{6-16}$ alkyl sulfates—alkane sulfonates and alkyl diphenyl oxide disulfonates. One particularly preferred sulfate is sodium lauryl ($C_{12}$) sulfate, available from Stepan Chemical Co., under the brand name Stepanol WAC. A preferred alkane sulfonate is Bio-Terge PAS 8S, which is an octane sulfonate. In general, the $C_{6-16}$ alkane sulfonates are preferred. Other manufacturers of alkane sulfonates include Hoechst AG, under the brand Hostapur. The alkyl diphenyl oxide disulfonates are atypical surfactants and preferably include an alkyl chain group of $C_{6-20}$. The preferred alkyl diphenyl oxide disulfonates are from Dow under the brand name Dowfax. Especially preferred is Dowfax 3B2, an n-decyl diphenyloxide disulfonate. Pilot Chemical, with Calfax, is another source of the alkyl diphenyl oxide disulfonate surfactant.

In the invention, it was determined that the alkyl diphenyl oxide disulfonates are especially preferred. In addition to their improvement to cleaning performance, these surfactants enhance the inventive cleaners with the advantageous characteristic of an auditory signal when a hard surface is cleaned therewith. Specifically, when a cleaner formulated with said alkyl diphenyl oxide disulfonates is applied to a glossy hard surface, preferably glass or mirrored surfaces, and is then removed therefrom with the aid of a squeegee or wicking instrument, such as a cleaning cloth, sponge, or the like, a distinct "squeak" or squeal is heard, which signals the user that complete removal of the cleaner, and the soil, has been accomplished.

Further, a particular blend of anionic surfactants in this invention, alkane sulfonates, alkyl sulfates and alkyl diphenyl oxide disulfonates, is preferred because of the advantageous properties of imparting to the cleaner good physical stability, excellent streaking/filming performance, low to minimal foaming and the auditory "clean" signal.

The amounts of surfactants present are to be somewhat minimized, for purposes of cost-savings and to generally restrict the dissolved actives which could contribute to leaving behind residues when the cleaner is applied to a surface. In a preferred composition, the total amount of surfactant is present, in a range of about 0.001–10%, more preferably about 0.001–7.5%, and most preferably about 0.001–3%, total surfactant. In the typical hard surface cleaners of this invention, and where a mixture of anionic/alkylpyrrolidone is used, the amounts added are generally about 0.001–2%, more preferably 0.002–0.75% anionic surfactant and generally 0.005–2%, more preferably 0.01–1% alkylpyrrolidone surfactant, in the cleaner, although it is again most preferred execution of the invention, the total amount of surfactant should not exceed about 1%. The ratios of surfactants are generally about 1:1,000 to 1,000:1.

3. Alkylpyrrolidones

The 1-alkyl-2-pyrrolidones can provide a dual function in this invention. First, one of the desirable adjuncts which are added to this system are fragrances, which are typically water-immiscible to slightly water-soluble oils. In order to keep this fairly immiscible component in solution, a co-solvent or other dispersing means was necessary. It was determined that 1-alkyl-2-pyrrolidones were particularly effective at so solubilizing the fragrance oils. The compound has the general structure:

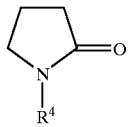

wherein $R^4$ is a $C_{6-20}$ alkyl, or $R^5NHCOR^6$, and $R^5$ is $C_{1-6}$ alkyl and $R^6$ is $C_{6-20}$ A particularly preferred alkyl pyrrolidone is lauryl (or n-dodecyl) pyrrolidone, sold by ISF Chemicals under the brand name Surfadone, such as Surfadone LP-300. Relatively low amounts of the alkyl pyrrolidone are used, preferably, about 0.001–2%, when the level of fragrance is from about 0.01–5%.

4. Buffer System

The buffer system comprises a nitrogenous buffer which is added to the aqueous hard surface cleaners of the invention so as to result in a pH of greater than 6.5, more preferably, between 7 and 14, most preferably between 7 and 13. The buffer can be selected from the group consisting of: ammonium or alkaline earth carbamates, ammonium carbonate, ammonium bicarbonate, diammonium carbonate, ammonium hydroxide, ammonia (which forms ammonium hydroxide in situ when added to water) and mixtures thereof. Optionally and preferably, the co-buffer is selected from ammonium and alkaline earth metal hydroxides. A combination of ammonium carbamate and ammonium hydroxide is most preferred.

The nitrogenous buffer is a significant aspect of the invention. Because of its presence, greatly enhanced reduction in streaking and filming of hard surfaces is achieved after the inventive cleaner is used to clean the same. The preferred nitrogenous buffers are ammonium carbamate, ammonium bicarbonate, ammonium carbonate and ammonium hydroxide. Ammonium carbamate has the structure $NH_2COO^-NH^+_4$. Use of this particularly preferred buffer obtains outstanding reduction in filming/streaking. It is available from BASF Corp. Ammonium carbonate and bicarbonate are other, further desirable buffers. Mixtures of any of the foregoing can be used as the buffer in the buffering system. Most of these materials can be obtained from general chemical supply houses, e.g., Aldrich Chemicals.

Additionally, it is especially preferred to add, as a co-buffer, an ammonium or alkaline earth hydroxide. Most preferred is ammonium hydroxide, which volatilizes relatively easily after being applied, resulting in minimal residue. Ammonium hydroxide also emulsifies fatty soils to a certain extent.

The amount of nitrogenous buffer added should be in the range of 0.01–2%, more preferably 0.01–1%, by weight of the cleaner, while hydroxide, if present, should be added in the range of 0.001–1% by weight of the cleaner.

5. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is most preferred.

Small amounts of adjuncts can be added for improving cleaning performance or aesthetic qualities of the cleaner. Adjuncts for cleaning include additional surfactants, such as those described in *Kirk-Othmer, Encyclopedia of Chemical Technology,* 3rd Ed., Volume 22, pp. 332–432 (Marcel-Dekker, 1983), which are incorporated herein by reference. Inorganic builders, such as silicates and phosphates, are generally avoided in this cleaner, especially those which will contribute a large amount of solids in the formulation which may leave a residue. Aesthetic adjuncts include fragrances, such as those available from Givaudan-Roure, Belmay, Bush Booke and Allen, Henkel KGaA, Firmenich, Dragoco, IFF, Quest and others, and dyes and pigments which can be solubilized or suspended in the formulation, such as diaminoanthraquinones. The choice of color is left to the formulator, although various shades and hues of yellow, purple, green and blue, as well as colorless, are preferred. As mentioned above, the fragrance oils typically require a dispersant, which role is fulfilled by the alkylpyrrolidone, and the anionic surfactant. As previously noted, a fragrance is well dispersed by the alkylpyrrolidone while at least maintaining, if not improving, the non-streaking/non-filming performance of the inventive cleaner. The amounts of these cleaning and aesthetic adjuncts should be in the range of 0–2%, more preferably 0–1%.

An additional adjunct of interest herein is hydrotropes, specifically, short chain alkylaryl sulfonates, more specifically, $C_{1-4}$ alkylaryl sulfonates, such as, without limitation, benzene, naphthalene, xylene, cumene and toluene sulfonates. These are typically alkali metal salts and, although it has been cautioned herein that the total level of alkali metal salts is to be limited, in fact, for certain purposes, such as hard surface cleaning (e.g., tile, composite materials such as Formica® and Corian® countertops, and the like), incorporation of hydrotropes in a discrete level may be quite acceptable. The preferred hydrotrope herein is alkali metal xylene sulfonate, wherein the alkali metal is potassium, sodium or lithium. An ammonium salt may also be acceptable. The amount of short chain alkylaryl sulfonate may be kept economically low, i.e., preferably about 0.01–2%, more preferably 0.02–1% and most preferably, about 0.05–1%. Preferred hydrotropes, among others, include sodium xylene sulfonate, sold in various active levels by Stepan Chemical Company under the brand name Stepanate SXS. Other preferred hydrotropes may be found from Colborn et al., U.S. Pat. No. 4,863,633, column 8, line 20 to column 10, line 22, which are incorporated by reference thereto.

In the following Experimental section, the surprising performance benefits of the various aspects of the inventive cleaner are demonstrated.

Experimental

The following experiments demonstrate the unique cleaning performance of the inventive cleaner.

EXAMPLE 1

In Table I below, base formulation "A" is set forth. Generally, the below examples of the compositions of this invention, as well as most of the comparative examples, will be based on the base formulation "A." Unless otherwise stated, percentages are given as 100% active, and in percent by weight.

TABLE I

| Ingredient | Formulation A |
|---|---|
| iso-Propyl Alcohol | 4.0% |
| Ethyleneglycol Monobutyl Ether | 2.50% |
| Primary Alkane Sulfonate | 0.05% |
| Diphenyl Oxide Disulfonate | 0.05% |
| Sodium Lauryl Sulfate | 0.02% |
| Dodecyl Pyrrolidone | 0.012% |
| Ammonium Carbamate | 0.18% |
| Fragrance | 0.08% |
| Ammonia | 0.04998% |
| Blue Dye(s) | 0.0030% |
| Deionized Water | remainder to 100% |

In general, to test the streaking/filming performance of the formulations, a small sample thereof was sprayed on glass mirror tiles and then wiped off. The results were graded by a panel of expert graders, on a scale of 0 to 10, with 0 being the worst and 10, the best.

In Examples 2–6 below, to further demonstrate the uniqueness and exemplary performance of the surfactant mixture and selected buffers, experiments were conducted in which the invention (Examples 3–6, each example containing a different fragrance base) was compared against a comparative formulation Example 2 (a commercially available cleaner) containing a different surfactant blend. In this experiment, the formulations were simply sprayed via a trigger sprayer (consistently, two short bursts) onto glass mirror tiles, and not wiped or wicked off. Then, as discussed above, graded by an expert panel of graders on a 0 to 10 scale (the samples were randomized and the panelists were not informed of the identity of the samples). Examples 3–5 contained the surfactant blend of Example 1.

In Examples 7–11, the same test was performed, but the surface was heated to 38° C. (100° F.), to demonstrate high temperature streaking/filming performance. Again, the first example, 7, was the commercially formulated cleaner. 8–11 were of the invention. In these examples, it was demonstrated that the high temperature streaking/filming performance was even better.

The results are demonstrated in TABLES II & III.

TABLE II

Evaluation of Non-wiped glass tiles

| Example | Surfactant | Buffer | Avg'd Grade |
|---|---|---|---|
| 2 (Control) | Cocoamidopropyl-dimethyl-amine oxide | Carbamate | 8.8 |
| 3 | See Table I, Formulation A | Carbamate | ~8.9 |
| 4 | See Table I, Formulation A | Carbamate | ~9 |
| 5 | See Table I, Formulation A | Carbamate | ~9.1 |
| 6 | | Carbamate | ~9.2 |

TABLE III

Evaluation of Non-wiped glass tiles @ 38° C.

| Example | Surfactant | Buffer | Avg'd Grade |
|---|---|---|---|
| 7 (Control) | Cocoamidopropyl-dimethyl amine oxide | Carbamate | 8.1 |
| 8 | See Table I, Formulation A | " | ~8.5 |
| 9 | See Table I, Formulation A | Carbamate | ~8.8 |
| 10 | See Table I, Formulation A | " | ~8.8 |
| 11 | See Table I, Formulation A | " | ~9.0 |

From the foregoing table, it can be seen that the invention, as demonstrated by Examples 3–6 and 8–11, showed excellent results. This was very unexpected.

The invention is further defined without limitation of scope or of equivalents by the claims which follow.

We claim:

1. An aqueous, hard surface cleaner with significantly improved residue removal and substantially reduced filming/streaking, said cleaner comprising:

(a) no more than about 50% of at least one organic solvent with a vapor pressure of at least 0.001 mm Hg at 25° C., and mixtures of such solvents;

(b) about 0.001–10% of a mixture of anionic surfactants, which comprise $C_{6-20}$ alkyl diphenyloxide disulfonate and either $C_{6-20}$ alkane sulfonate or $C_{6-20}$ alkyl sulfonate, or a mixture of all three, the alkyl diphenyloxide disulfonate providing a distinct auditory signal when a glossy hard surface is cleaned with said hard surface cleaner;

(c) about 0.01–2% of a buffering system which comprises a nitrogenous buffer which will result in a pH of greater than 6.5; and (d) the remainder as substantially all water.

2. The hard surface cleaner of claim 1 wherein said solvent is an alkanol which is selected from the group consisting of methanol, ethanol, n-propanol, isopropanol, butanol, pentanol, hexanol, their positional isomers, and mixtures of the foregoing.

3. The hard surface cleaner of claim 1 wherein said solvent is an alkylene glycol ether which is selected from the group consisting of ethylene glycol monobutyl ether, ethylene glycol monopropyl ether, propylene glycol monopropyl ether, propylene glycol monobutyl ether, and mixtures thereof.

4. The hard surface cleaner of claim 3 wherein said solvent is ethylene glycol monobutyl ether.

5. The hard surface cleaner of claim 3 wherein said solvent is propylene glycol n-butyl ether.

6. The hard surface cleaner of claim 3 wherein said solvent is propylene glycol t-butyl ether.

7. The hard surface cleaner of claim 1 wherein said buffer is ammonium carbamate.

8. The hard surface cleaner of claim 7 wherein said buffer further includes an ammonium hydroxide.

9. The hard surface cleaner of claim 1 wherein said mixture of surfactants comprises the $C_{6-20}$ alkyl diphenyl oxide disulfonate and the $C_{6-16}$ alkyl sulfate.

10. The hard surface cleaner of claim 9 further comprising a $C_{6-16}$ alkane sulfonate.

11. A method of cleaning soil, without substantial residue remaining, from a hard surface comprising applying the cleaner of claim 1 to said soil and removing said soil and said cleaner.

12. The method of claim 11 wherein said applying step further comprises the metered delivery of said cleaner from a trigger sprayer.

13. The method of claim 11 wherein said applying step further comprises the metered delivery of said cleaner from a pump sprayer.

14. An aqueous, glass or glossy hard surface cleaner with significantly improved residue removal and substantially reduced filming/streaking, said cleaner delivering an auditory signal upon removal from said glass or glossy hard surface, said cleaner comprising:

(a) no more than about 50% of at least one water soluble or water-miscible organic solvent with a vapor pressure of at least 0.001 mm Hg at 25° C., and mixtures of such solvents;

(b) about 0.001–10% of a mixture of anionic surfactants, which comprise $C_{6-20}$ alkyl diphenyloxide disulfonate and either $C_{6-20}$ alkane sulfonate or $C_{6-20}$ alkyl sulfonate, or a mixture of all three, the alkyl diphenyloxide disulfonate providing a distinct auditory signal when a glossy hard surface is cleaned with said hard surface cleaner;

(c) about 0.01–2% of a buffering system which comprises a nitrogenous buffer which will result in a pH of greater than 6.5; and (d) the remainder as substantially all water.

15. The hard surface cleaner of claim 1 wherein said mixture of surfactants comprises the $C_{6-20}$ alkyl diphenyl oxide disulfonate and the $C_{6-16}$ alkane sulfonate.

16. The hard surface cleaner of claim 10 or 15 further comprising an alkyl pyrrolidone.

* * * * *